US006142116A

United States Patent [19]

Freese, V

[11] Patent Number: 6,142,116

[45] Date of Patent: Nov. 7, 2000

[54] INTERNAL COMBUSTION ENGINE WITH CYLINDER HEAD HAVING UNIQUE HEAD BOLT MOUNTING AND PORT ARRANGEMENT

[75] Inventor: Charles Edwin Freese, V, Westland, Mich.

[73] Assignee: Detroit Diesel Corporation, Detroit, Mich.

[21] Appl. No.: 09/354,539

[22] Filed: Jul. 15, 1999

[51] Int. Cl.[7] ..... F02F 1/42

[52] U.S. Cl. ..... 123/193.3; 123/188.14; 123/432

[58] Field of Search ..... 123/193.3, 193.5, 123/302, 315, 188.14, 432

[56] References Cited

U.S. PATENT DOCUMENTS

| | | | |
|---|---|---|---|
| 2,687,714 | 8/1954 | Flatz et al. | 123/193.3 |
| 4,612,885 | 9/1986 | Yoshikawa | 123/193.3 |
| 4,681,069 | 7/1987 | Honma | 123/193.3 |

FOREIGN PATENT DOCUMENTS

| | | | |
|---|---|---|---|
| 844352 | 8/1960 | United Kingdom | 123/188.14 |

*Primary Examiner*—Willis R. Wolfe
*Assistant Examiner*—Katrina B. Harris
*Attorney, Agent, or Firm*—Bill C. Panagos

[57] ABSTRACT

An internal combustion engine including an engine block having a top wall and a plurality of longitudinally aligned, spaced cylinders. A cylinder head has upper and lower walls with side walls extending therebetween. The cylinder head is mounted to the engine block with the lower walls sealingly opposing the top wall of the block so as to close the open ends of the cylinders. The cylinder head includes at least four passages associated with each of the cylinders extending through the cylinder head for delivering intake air to the associated cylinder and for removing exhaust gas from the associated cylinder. Each of these passages include an inlet, an outlet in fluid communication with the associated cylinder and a flow path extending therebetween. At least one of these passages includes a boss which is recessed in the passage and aligned with the inlet and which is adapted to receive a fastener employed to clamp the cylinder head to the engine block.

8 Claims, 2 Drawing Sheets

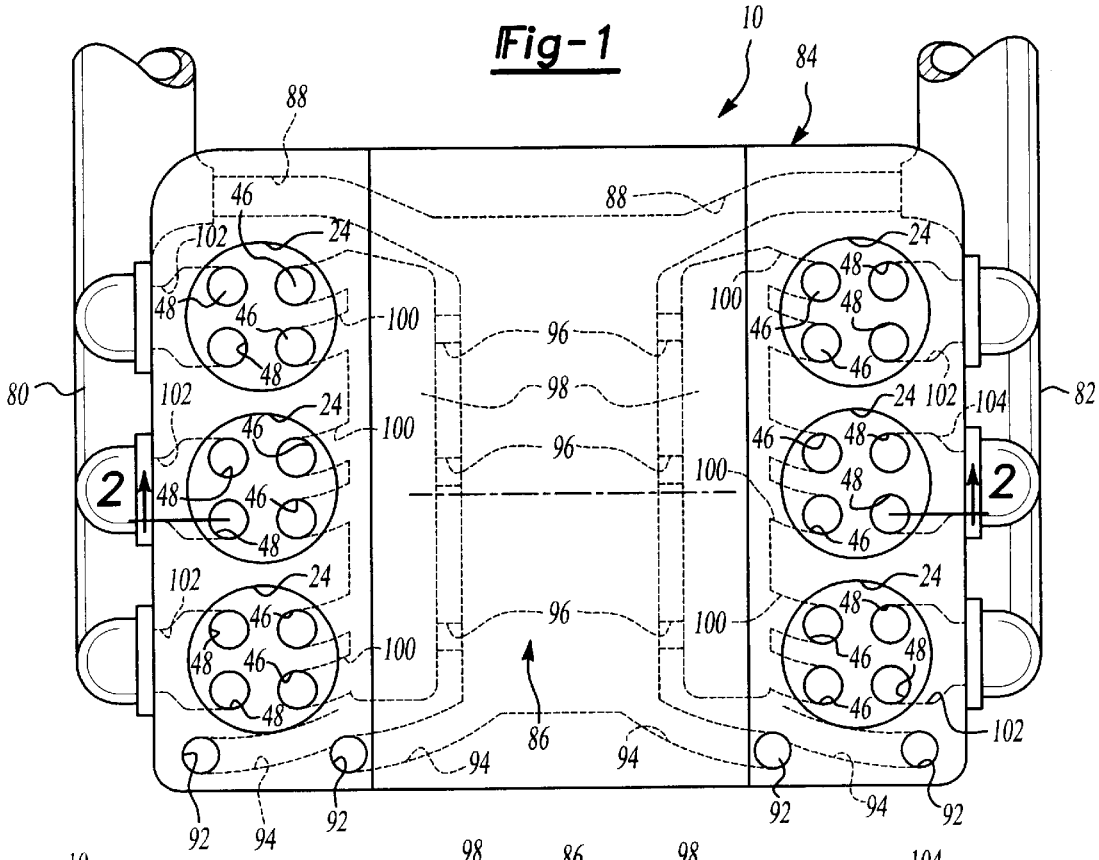
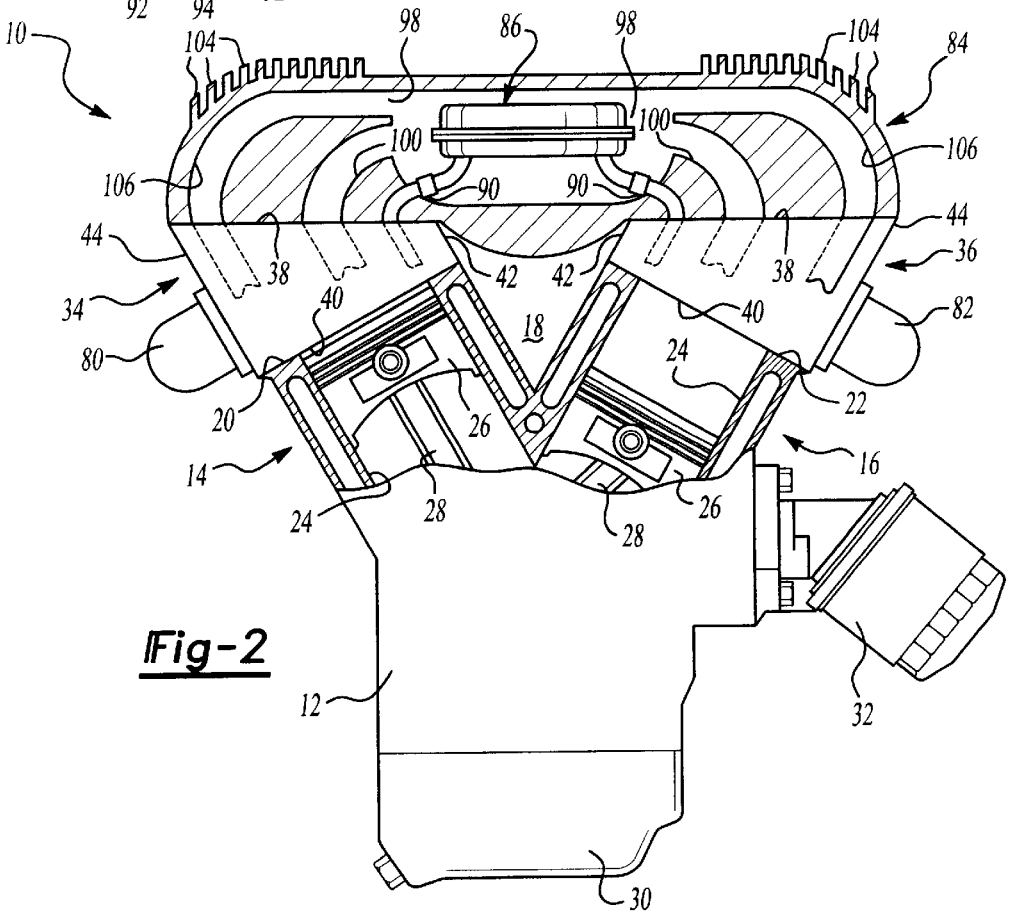
Fig-2

INTERNAL COMBUSTION ENGINE WITH CYLINDER HEAD HAVING UNIQUE HEAD BOLT MOUNTING AND PORT ARRANGEMENT

BACKGROUND OF THE INVENTION

1. Field of the Invention

The present invention is generally directed toward internal combustion engines and, more specifically, to an internal combustion engine with a cylinder head having a unique head bolt mounting and port arrangements.

2. Description of the Related Art

Internal combustion engines known in the related art may include, among other basic components, a cast engine block having a pair of cylinder banks arranged in a V-shaped configuration, a pair of cylinder heads associated with each cylinder bank mounted to the engine block and a pair of valve covers fastened to each cylinder head. Each bank of cylinders is usually serviced by a dedicated intake manifold mounted to each cylinder head. A plurality of pistons are reciprocated in cylinders formed in each cylinder bank of the engine block. Similarly, a plurality of valves supported in each cylinder head are opened and closed via rocker arms, cams or some other mechanism to provide fluid communication between the cylinders and intake and exhaust manifolds. Fuel is combusted within the cylinders to reciprocate the pistons which, in turn, act on a crankshaft from which power may be translated to drive an automotive vehicle or any number of other devices.

In the case of compression ignition or diesel engines, the fuel/air mixture is delivered at relatively high pressures via fuel injector assemblies. Presently, conventional injectors are delivering this mixture at pressures as high as 32,000 psi. These are fairly high pressures and have required considerable engineering attention to a number of engine components to ensure the structural integrity, good sealing properties and the effective atomization of the fuel within the combustion chamber.

In addition, modern, high speed, direct injection diesel engines often employ cylinder heads having four valves per cylinder to meet challenging performance, noise and emission targets. However, four-valve configurations typically present difficult packaging challenges for small bore, direct injection, diesel engines. As higher engine efficiencies are targeted, engine designers are pushing engines to achieve higher peak firing pressures, necessitating higher head bolt clamp loads. This requirement further complicates the cylinder head and intake port packaging approach.

Many diesel engines adapted for automotive applications in North America will require lower valve train costs to compete effectively with gasoline engines. This factor, among other things, has resulted in the use of an overhead valve (OHV) configuration in the cylinder head, rather than the more generally accepted single overhead camshaft (SOHC) or dual overhead cam shaft (DOHC) design. Especially when employed in connection with V-block engines, overhead valve configurations achieve the necessary automotive diesel-rated speeds with sufficient valve train stiffness, while at the same time resulting in lower overall costs. Further, overhead valve configurations reduce total friction when compared with single or double overhead cam configurations. However, engines which employ overhead valve configurations also require push rods to actuate the valve rocker. Push rods present an additional space claim in the already crowded cylinder head envelope.

In essence, then, the modern diesel engine must provide a substantial fuel economy advantage while meeting evermore stringent emission regulations which are imposed on smaller, more compact diesel engines. However, increasing demands for greater fuel economy, cleaner burning, fewer emissions, $NO_x$ and noise control in addition to better component packaging, have placed, and will continue to place, even higher demands on the engine. Thus, there is an ongoing need in the art for better control over these various parameters in a cost-effective manner.

SUMMARY OF THE INVENTION

The present invention overcomes the deficiencies in the related art in an internal combustion engine including an engine block having a top wall and a plurality of longitudinally aligned, spaced cylinders. A cylinder head having upper and lower walls with side walls extending therebetween is mounted to the engine block with the lower wall sealingly opposing the block so as to close the open ends of the cylinders. The cylinder head includes at least four passages associated with each of the cylinders extending through the cylinder head for delivering intake air to the associated cylinder and for removing exhaust gas from the associated cylinder. Each of these passages includes an inlet, an outlet in fluid communication with the associated cylinder and a flow path extending therebetween. At least one of the passages includes a boss which is recessed in the passage and aligned with the inlet. The boss is adapted to receive a fastener employed to clamp the cylinder head to the engine block.

The present invention facilitates efficient engine component packaging objectives by recessing a fastener boss within at least one of the four passages associated with each cylinder. In this way, the fastener, such as a head bolt, may occupy the same position when viewed as a projection upon the fire deck surface and thus fastener positions and passage geometry may be better optimized.

Accordingly, one advantage of the present invention is that large diameter passages, such as intake ports, may be maintained without necking or complicated bends which would otherwise be required to avoid bolt bosses and water jacket passages.

Another advantage of the present invention is that it provides added flexibility to improve head bolt clamp load and gasket pressure distribution.

Another advantage of the present invention is that tangential-tangential and tangential-helical passage designs are feasible with minimal impact on optimal head bolt positioning.

Another advantage of the present invention is that it provides improved flexibility for cooling near ports and bolt bosses.

Still another advantage of the present invention is that it provides increased head stiffness because the passage walls may function like vertical ribs.

Still another advantage of the present invention is that it permits shorter passages for reduced pressure losses.

BRIEF DESCRIPTION OF THE DRAWINGS

Other advantages of the invention will be readily appreciated as the same becomes better understood by reference to the following detailed description when considered in connection with the accompanying drawings, wherein:

FIG. 1 is a top view of the V-block internal combustion engine illustrating the cylinder head having four passages associated with each cylinder of the present invention;

FIG. 2 is a cross-sectional side view of a V-block internal combustion engine taken substantially along lines 2—2 of FIG. 1.

DETAILED DESCRIPTION OF THE PREFERRED EMBODIMENT(S)

Figure 3:
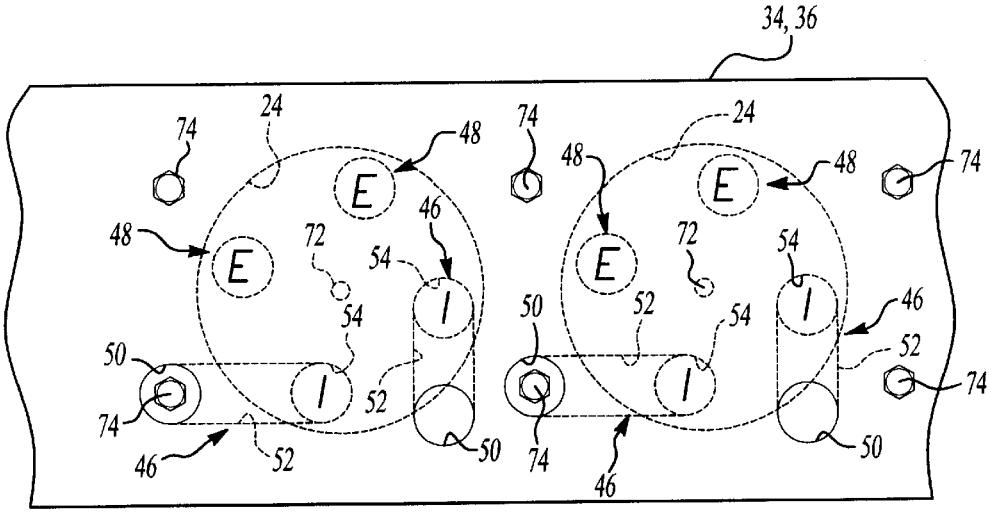
FIG. 3 is a partial top view of the passages associated with a pair of cylinders.

Referring now to FIGS. 1 and 2, an internal combustion engine is generally indicated at 10. In the preferred embodiment, the engine 10 is a compression ignition, or diesel engine, but those having ordinary skill in the art will appreciate that the engine 10 may also be a spark ignition engine. The engine 10 includes a cast engine block 12 having a pair of cylinder banks, generally indicated at 14 and 16, arranged in a V-shaped configuration so as to define a valley or plenum 18 therebetween. Because of this V shape, each of the cylinder banks 14, 16 present a top wall or "fire deck" 20, 22, respectively, which is disposed at an acute angle relative to a horizontal plane when viewed in cross-section as shown in FIG. 2. Further, each cylinder bank 14, 16 includes a plurality of open-ended cylinders 24 disposed spaced from one another and longitudinally aligned within each cylinder bank 14, 16. However, those having ordinary skill in the art will appreciate that the present invention is not limited to V-block engines and may be employed with any style block configuration.

A piston 26 is reciprocally supported in each of the cylinders 24. Each piston 26 is connected by a connecting rod 28 to a crankshaft (not shown) journaled in a conventional fashion in the lower portion of the cylinder block 12. Fuel is combusted within the cylinders 24 which reciprocates the pistons 26 which, in turn, act on the crankshaft. From the crankshaft power may be translated to drive an automotive vehicle, or any number of other devices. An oil pan 30 is secured below the engine block 12 and provides a sump for oil used in lubricating the various parts of the engine. An oil filter 32 is mounted to the engine block 12 to filter contaminants which are picked up by the oil during lubrication.

In the embodiment disclosed herein at FIG. 2, a pair of cylinder heads, generally indicated at 34 and 36, are associated with the pair of cylinder banks 14, 16, respectively. Each of the cylinder heads 34, 36 include upper and lower walls 38, 40. The upper and lower walls 38, 40 are disposed at angles relative to each other such that each cylinder head 34, 36 is substantially wedge-shaped in cross-section as shown in FIG. 2. Furthermore, each cylinder head 34, 36 includes inner and outer side walls 42, 44, respectively, and front and rear walls (not indicated by reference numerals). The inner and outer 42, 44 as well as the front and rear walls all extend between the upper and lower walls 38, 40.

The cylinder heads 34, 36 are mounted to the engine block 12 such that the lower wall 40 of each of the cylinder heads 34, 36 seals the opposing top wall or "fire deck" 20, 22 of the associated cylinder bank 14, 16 so as to close the open end of the cylinders 24. Furthermore, the cylinder heads 34, 36 are mounted to the engine block 12 such that the upper wall 38 of each of the cylinder heads 34, 36 is substantially parallel to a horizontal plane when viewed in cross-section as shown in FIG. 2. The walls 38–44 as well as the front and rear walls enclose a coolant jacket adapted to receive liquid coolant for cooling the various parts of each cylinder head 34, 36.

Figure 4:
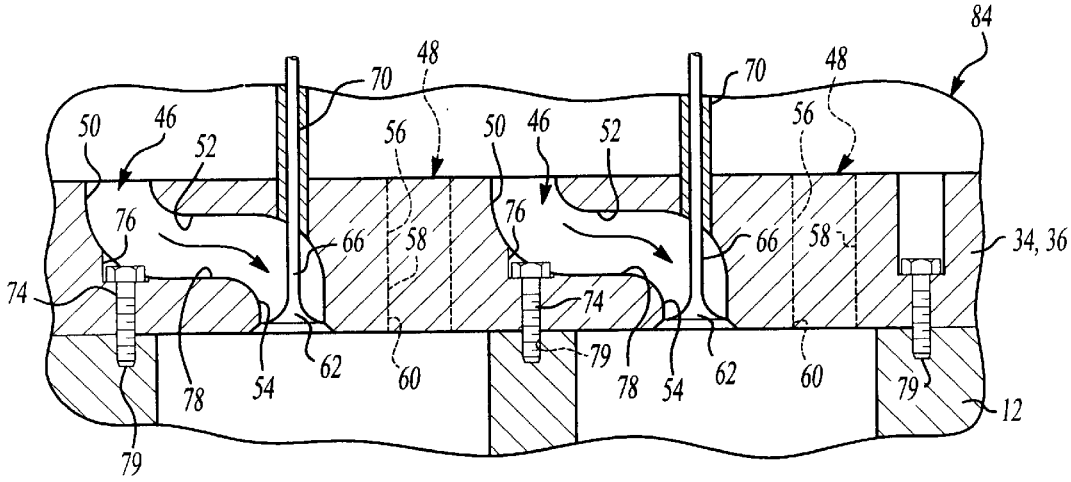
FIG. 4 is a partial cross-sectional side view of a pair of passages associated with a pair of cylinders and illustrating a boss recessed therein and a head bolt received through said boss.
Figure 5:
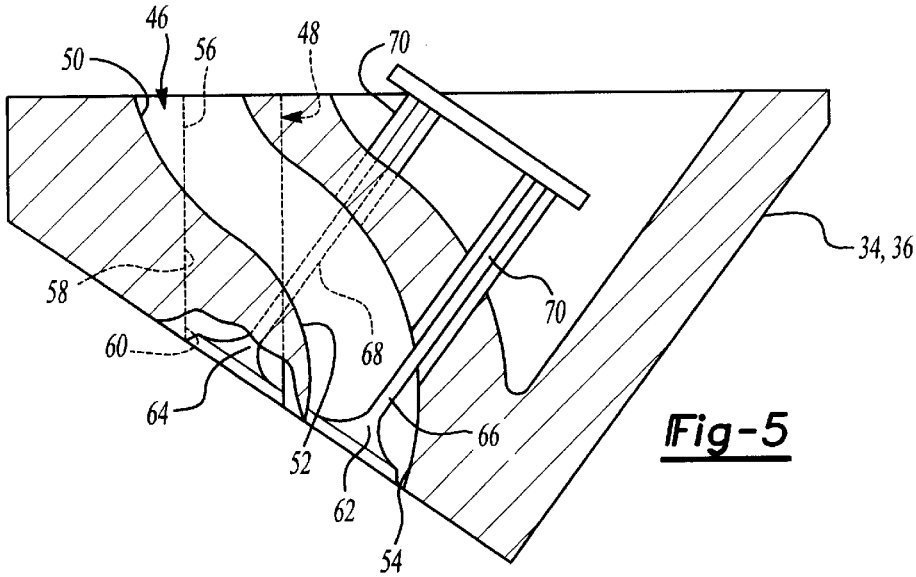
FIG. 5 is a partial cross-sectional side view of one of the passages illustrated in FIG. 3 used in connection with a wedge-shaped cylinder head of the type illustrated in FIG. 2.

The cylinder heads 34, 36 include at least four passages associated with each of the cylinders 24 extending through the cylinder heads 34, 36 for delivering intake air to the associated cylinder 24 and for removing exhaust gas from the associated cylinder 24. More specifically, these four passages include two intake passages, generally indicated at 46 and two exhaust passages, generally indicated at 48, associated with each of the cylinders 24 as schematically indicated in FIG. 1 but best shown in FIGS. 3–5. Each of the intake passages 46 includes an inlet 50, an outlet 54 in fluid communication with the associated cylinder 24 and a flow path 52 extending therebetween. Likewise, each of the exhaust passages 48 includes an inlet 60, an outlet 56 in fluid communication with the associated cylinder 24 and a flow path 58 extending therebetween. As best shown in FIGS. 3 through 5, the inlet 50 and outlet 54 of at least one of the intake passages 46 for each cylinder 24 are spaced laterally relative to one another with the flow path 52 extending therebetween. The flow path 52 therefore has an S shape. As illustrated in the figures, two of the intake passages 46 for each cylinder 24 have an S-shaped flow path 52. As shown in FIG. 4, the outlet 54 is aligned substantially parallel to the axis of the associated cylinder. However, the outlet 54 may also be aligned in a non-parallel disposition with respect to the axis of the associated cylinder 24. As illustrated in FIGS. 3 and 5, the exhaust passages 48 are substantially straight. However, those having ordinary skill in the art will appreciate that the inlet 60 and outlet 56 of the exhaust passage 48 may be spaced laterally such that the exhaust flow path 58 has an S shape. However, in the preferred embodiment, it is the intake passages 46 which are configured in this way.

A plurality of valves, generally indicated at 62 and 64, are reciprocally carried by the cylinder heads 34, 36 between open and closed positions to control the flow to and from the cylinders 24 through the outlets 54, 56 in the intake and exhaust passages 46, 48, respectively. The valves 62 are associated with the intake passages 46 and the valves 64 are associated with the exhaust passages 48. Each valve 62, 64 has a stem 66, 68, respectively, which extends through corresponding holes drilled through the cylinder heads 34, 36 and are stabilized by bushings 70 or the like. Each valve 62, 64 is actuated by rocker arms. In turn, the rocker arms are actuated by push rods connected with spring biased followers which engage cams of a camshaft driven via other related components by the crankshaft. For each cylinder location, the cylinder heads 34, 36 carry a number of other components, for example, an injector schematically and positionally represented at 72 in FIG. 3, all of which are conventional and not shown here. Similarly, the engine 10 also includes a number of other conventional components which are commonly known in the art and will not be described in greater detail.

As illustrated in FIGS. 3 and 4, a plurality of fasteners 74 are associated with each of the cylinders 24 and are employed to clamp the cylinder heads 34, 36 to the engine block 12. At least one of the passages 46, 48 includes a boss 76 recessed in the passage 46, 48 and aligned with the inlet 50, 56. More specifically, the boss 76 is formed on the land 78 which is the first transverse surface formed by the S-shaped flow passage. The boss 76 is adapted to receive a fastener 74. In the preferred embodiment illustrated in the Figures, it is the intake passage 46 which includes the boss 76, but those having ordinary skill in the art will appreciate that the bosses 76 could also be formed in an S-shaped exhaust passage 48. In the embodiment illustrated here, the fastener 74 includes a headed bolt which is threadably received in the boss 76 and extends into threaded contact with a correspondingly threaded passage 79 in the engine block 12. However, those having ordinary skill in the art will appreciate that other types of fasteners could be used without departing from the scope of the invention.

Together, the plurality of threaded bolts 74 act to clamp the cylinder heads 34, 36 to the engine block 12. However, the internal combustion engine 10 of the present invention differs from the prior art in that at least one bolt 74 associated with each cylinder 24 may be received in a recessed boss 76 within one of the passages 46, 48 thereby occupying the same position as the inlet to the passage 46, 48 when viewed as a projection from the fire deck or top walls 20, 22 of the engine block 12. Accordingly, fastener positions and passage geometry may be better optimized. Furthermore, large diameter passages 46, 48 having bell mouth inlets 50, 56, may be maintained without necking or complicated bends which would otherwise be required to avoid bolt bosses and water jacket passages. This feature provides added flexibility to improve head bolt clamp load, gasket pressure distribution and improved flexibility for cooling near ports and bolt bosses. In addition, tangential-tangential and tangential-helical passage designs are feasible with minimal impact on optimal head bolt positioning. The S-shaped passage walls also act like vertical ribs which provide increased cylinder head stiffness and also permit shorter passages for reduced pressure losses.

Referring now to FIGS. 1 and 2, the internal combustion engine 10 also includes a pair of exhaust manifolds 80, 82 mounted to the outer side walls 44 of each of the pair of cylinder heads 34, 36. A single, integrated intake manifold and rocker cover 84, generally indicated at 84, is mounted to the horizontal upper walls 38 of the pair of cylinder heads 34, 36 and spans the plenum 18 defined by the V-shaped pair of cylinder banks 14, 16. The integrated manifold and rocker cover 84 provides intake air to the cylinders 24 in each of the pair of cylinder banks 14, 16 through the intake passages 46 in the pair of cylinder heads 34, 36. Furthermore, the integrated manifold and rocker cover 84 also recirculates exhaust gas from the pair of exhaust manifolds 80, 82 to each of the cylinders 24 in the cylinder banks 14, 16. To this end, the integrated manifold and rocker cover includes an exhaust gas recirculating (EGR) cooler core, generally indicated at 86, which is removably mounted centrally therein and in fluid communication with the exhaust manifolds 80, 82 via delivery passages 88 located at the upper end of the top view of FIG. 1 for cooling the exhaust gas before it is delivered to the cylinders 24. The EGR cooler core 86 may also include EGR valves, schematically represented at 90 in FIG. 2, and possibly other related components which are not shown. As best shown in FIG. 1, the cylinder heads 34, 36 include coolant connectors 92 interconnecting the coolant jacket in the cylinder heads 34, 36 with the EGR cooler core 86. Similarly, the integrated manifold and rocker cover 84 includes coolant passages 94 which communicate between the coolant connection 92 and the EGR cooler core 86. The coolant connectors 92 and coolant passages 94 may be located opposite the delivery passages 88, as viewed in FIG. 1.

The integrated manifold and rocker cover 84 also includes a plurality of EGR introduction passages 96 spaced relative to one another and on either side of the EGR cooler core 60. The introduction passages 96 provide fluid communication between the EGR cooler core 86 and a pair of rail manifolds 98 formed in the integrated manifold and rocker cover 84 on either side of the EGR cooler core 86 as shown in FIG. 1. The rail manifolds 98 provide fluid communication between ambient intake air, the EGR cooler core 86 and the intake passages 46 formed in the cylinder heads via intake lines 100. Exhaust lines 102 provide fluid communication between the exhaust passages 48 and the exhaust manifolds 80, 82.

As illustrated in FIG. 2, the integrated intake manifold and rocker cover may also include cooling fins 104 formed on the outer surface thereof to assist in cooling the exhaust gas flowing through channels 106 formed in the manifold (FIG. 2). Further, the coolant connectors 92, coolant passages 94 as well as the EGR introduction passages 96 act to minimize noise transmission from the engine to the environment.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

I claim:

1. An internal combustion engine comprising:

an engine block having a top wall and a plurality of longitudinally aligned, spaced cylinders;

a cylinder head having upper and lower walls with side walls extending therebetween, said cylinder head being mounted to said engine block with said lower wall sealingly opposing said engine block so as to close the open ends of said cylinders;

said cylinder head including at least four passages associated with each of said cylinders extending through said cylinder head for delivering intake air to said associated cylinder and for removing exhaust gas from said associated cylinder, each of said passages including an inlet, an outlet in fluid communication with said associated cylinder and a flow path extending therebetween;

at least one of said passages including a boss recessed in said passage and aligned with said inlet and which is adapted to receive a fastener employed to clamp said cylinder head to said engine block.

2. An internal combustion engine as set forth in claim 1 further including a plurality of valves reciprocally carried by said cylinder head between opened and closed positions to control the flow to and from said cylinders through said outlets in said passages.

3. An internal combustion engine as set forth in claim 1 wherein said fastener includes a headed bold threadably received in said boss and extending into threaded contact with a correspondingly threaded passage in said engine block for clamping said cylinder head to said engine block.

4. An internal combustion engine as set forth in claim 1 wherein said inlet and said outlet of said at least one passage are spaced laterally relative to one another with said flow path extending therebetween.

5. An internal combustion engine as set forth in claim 4 wherein said flow path has an S-shape and said outlet is aligned substantially parallel to the axis of the associated cylinder.

6. An internal combustion engine as set forth in claim 1 wherein said at least four passages includes two intake passages and two exhaust passages associated with each of said cylinders, a plurality of fasteners associated with each of said cylinders with at least one of said intake and exhaust passages including said recessed boss which is adapted to receive at least one of said fasteners.

7. An internal combustion engine as set forth in claim 6 wherein at least one of said intake passages includes said recessed boss adapted to receive one of said fasteners.

8. An internal combustion engine as set forth in claim 6 wherein at least one of said exhaust passages includes said recessed boss adapted to receive one of said fasteners.

* * * * *

UNITED STATES PATENT AND TRADEMARK OFFICE

CERTIFICATE OF CORRECTION

PATENT NO. : 6,142,116
DATED : July 19, 1999
INVENTOR(S) : Charles E. Freese, V

It is certified that error appears in the above-identified patent and that said Letters Patent is hereby corrected as shown below:

Column 1,
Line 5, after "BACKGROUND OF THE INVENTION", insert -- This invention was made with Government support under DE-FC05-97 OR22581 awarded by the United States Department of Energy. The Government has certain rights in this invention. --

Signed and Sealed this

Eleventh Day of September, 2001

*Attest:*

Nicholas P. Godici

*Attesting Officer*

NICHOLAS P. GODICI
*Acting Director of the United States Patent and Trademark Office*